United States Patent [19]

Grau

[11] 3,944,102

[45] Mar. 16, 1976

[54] SAFETY SCREW CLOSURE

[76] Inventor: Hermann Grau, Schwabenstr. 296, 7071 Lindach (Baden-Wurttemberg, Bundesrep. Deutschl.), Germany

[22] Filed: Mar. 30, 1973

[21] Appl. No.: 346,582

[30] Foreign Application Priority Data

Apr. 5, 1972 Germany ..... 2216343

[52] U.S. Cl. ..... 215/251; 215/214; 215/217; 215/220; 215/258; 215/318; 215/321

[51] Int. Cl.[2] ..... B65D 41/16; B65D 43/02

[58] Field of Search ..... 215/41, 42, 46 A, 9, 219, 215/220, 258, 214, 217, 318, 321

[56] References Cited

UNITED STATES PATENTS

| | | | |
|---|---|---|---|
| 2,140,732 | 12/1938 | Burke | 215/42 |
| 2,961,119 | 11/1960 | Leach | 215/42 X |
| 2,964,207 | 12/1960 | Towns | 215/9 |
| 3,260,393 | 7/1966 | Rabutz | 215/220 |
| 3,374,912 | 3/1968 | Velt | 215/9 |
| 3,394,829 | 7/1968 | Peterson | 215/9 |
| 3,650,426 | 3/1972 | Miller | 215/220 |
| 3,673,761 | 7/1972 | Leitz | 215/42 |
| 3,679,085 | 7/1972 | Gash | 215/220 |
| 3,795,338 | 3/1974 | Swartzburgh | 215/9 |

*Primary Examiner*—William Price
*Assistant Examiner*—Joseph M. Moy

[57] ABSTRACT

A safety screw closure for use with a container having an inner screw cap on to the bottom edge of which an elastically expandable securing ring is attached by at least one rupturable bridge member. An outer cap is mounted on the inner cap and slidable axially between a first position remote from the inner cap and second position. A spring is located between the caps to normally urge the outer cap into the first position. The caps are provided with at least one set of cooperating coupling means which are in cooperation in any axial position of the outer cap when the closure is screwed on to the container whereas they are ineffective when rotating the outer cap in the opposite direction and when the outer cap is ints first position in which it is not depressed against the spring. The outer cap being dimensioned so that when in the first position it extends above the securing ring. The container has a threaded neck for receiving said inner cap and a shoulder having an inclinedslide surface adapted to expand the securing ring when said closure is threaded thereon.

8 Claims, 6 Drawing Figures

SAFETY SCREW CLOSURE

BACKGROUND OF INVENTION

The present invention relates to a safety screw closure having a security seal ring for bottles, flasks or similar containers holding foods, medicines and the like.

A safety screw closure is disclosed in copending application Ser. No. 239,565, in which an inner cap adapted to be secured on the neck of a container and an outer cap snapped or graspingly held on the inner cap are provided with a spring located between their crowns. The outer cap is held on the inner cap with a degree of axial movement and is depressable downwardly against the force of the spring. The inner and outer cap are so formed with cooperable means that when the outer cap is not depressed a coupling is created which allows the closure to be screwed on to the container and that when the outer cap is depressed a coupling is created which permits the safety closure to be opened.

Several safety closures are known which have a so-called securing or seal ring so that a "original closure" is provided which insures an initially sealed condition. This securing ring is attached to the lower edge of the inner cap by a breakable or tearable connecting strip and initially cylindrical shape. When the closure is screwed for the first time onto the neck of the container the lower portion of the securing ring is deformed to engage beneath an annular shoulder of the container neck. When thermoplastic materials are employed to make the closure it is necessary to provide a special tool or implement to deform the securing ring in order to grip the shoulder as well as providing a source of heat in order to soften the material and prevent its breakage during such deformation. The mounting of the known closures having a securing ring are therefore unreasonably complex, uneconomical and difficult.

It is the object of the present invention to provide a safety screw closure having a securing seal ring which is simpler and easier to mount on the neck of the container than those of the known devices.

The numerous advantages and objects of the present invention are set forth as a part of the following disclosure of the present invention.

SUMMARY OF INVENTION

Briefly the objectives of the present invention are attained by providing a safety screw closure in combination with a container wherein the closure comprises an inner and outer cap and a securing seal ring adapted to be gripped and held beneath a shoulder provided on the neck of the container. The securing ring is arranged along the bottom edge of the inner cap and is attached to the cap by at least one tearable or rupturable member. The outer cap is held by the inner cap so as to be relatively moveable axially therewith between a first fixed stop position above the securing ring and a second fixed stop position which is depressed and contiguously aligned with the seal ring. A spring is arranged between the two caps which normally urges the outer cap into the first position, the outer cap being moveable against the force of the spring into the second depressed position. The caps are provided with at least one set of cooperating coupling means which when the closure is screwed on to the container, engage in the first position of the outer cap and when the closure is to be rescrewed, the coupling means are in engagement only with the outer cap in its second or depressed condition.

According to the present invention this structure permits the securing ring to readily distend and expand to move over the shoulder of the container when screwing the closure for the first time on to the container, because when the outer cap is in its first position (i.e.: not forced downwardly against the spring), then the outer cap is not contiguous with the securing ring and does not envelop it and prevent its expansion, or lies only in such a position that it permits radial play or movement of securing ring sufficient to allow it to expand. Thus the securing ring can expand and pass over the shoulder on the neck of the container. Preferably the shoulder is formed with a smooth inclined sliding surface which facilitates such movement. The closure of the present invention does not require any special tools in order to initially secure or place it over the neck of the container, since the automatically expandable securing ring allows the closure to be easily screwed on to the threads of the neck. Because the outer cap does not have to be depressed during the screwing, the securing ring is maintained free and is allowed to slide elastically over the smooth surface of the neck without any external interference. On further screwing the closure over the neck the securing ring snaps behind the shoulder and automatically engages with it fixedly in sealed position, on the neck of the container.

A further advantage of the present invention lies in the fact that means are provided to insure that the bridging members attaching the securing ring to the inner cap tear during the initial unscrewing of the closure from the container as is the common function with the conventional "original seal" closures. This is accomplished by providing the shoulder against which the securing ring is engaged and gripped with a non-slidable face or gripping edge which prevents the securing ring from being slideable in the unscrewing direction, and/or by providing the outer cap with an annular skirt which is so long that when the outer cap is depressed the skirt surrounds the securing ring preventing it from having any radial play or radial expansion and thereby insuring that the securing ring remains engaged with the shoulder even when the closure is turned to unscrew the cap.

Preferably, the closure is built so that when it is screwed on to the container, the coupling means between the outer and inner caps are caused to fixedly engage by having the outer cap abut against a fixed first upper stop member. The reason for this construction is to be seen from the fact that in the known safety closures as previously described, the outer and inner caps are not necessarily coupled together when the closure is screwed on to the container with the outer cap not being pushed into its down position. Thus the securing ring may, under certain circumstances, not be expandable. This may occur inadvertently, when by a desire to insure that the closure is properly placed on the container, the outer cap is inadvertently slightly depressed during the initial screwing operation and is subsequently moved into an area about the securing ring.

Screw closures for medicine and food bottles, flasks and the like were commonly made from polystyrene. This synthetic material is also suitable for use in making the known safety screw closures wherein the spring between the outer and inner caps are formed, because of material limitations, of separate pieces. In preparing the aforementioned safety screw closure in accordance with the present invention, the spring however is preferably formed integrally with one of the caps and particularly on the inner cap so that for the present closure devices an elastic thermoplastic material may be used. This makes the present invention very advantageous since by its concept the securing ring also must be elastically expandable. In a preferred embodiment, the inner cap and the securing ring are both formed from acetal or acetate resin to obtain the desired elasticity.

It is preferred, in any event, to provide the neck of the flask with an annular bead of particular configuration by which the securing ring may be easily grasped. Preferably, the cross section of the bead approximates in form that of a right triangle having a downwardly inclined face (hypotenuse) over which the securing ring slides when first put on the container and a horizontally extending leg over which the securing ring snaps and is held until the closure is unscrewed for the first time.

A further advantage of the present invention arises from the fact that the securing ring and the inner cap may be provided with intermediate engaging pieces or elements which connect the securing ring and inner cap for effective working action during initial screwing of the closure on the container but which engaging pieces are ineffective to connect the two when the closure is unscrewed for the first time. Preferably the lower edge of the inner cap and the upper edge of the securing ring are provided with a plurality of integrally formed engaging pieces in the form of extending cams dogs or lugs which are spaced from each other by a very small distance, in the direction of rotation when screwing the closure on to the container and are spaced by a larger distance in the opposite direction of rotation as when the closure is unscrewed. With this construction it is insured that the bridging members between the inner cap and the securing ring are not too strongly distorted so as to be ruptured when the closure is first put on the container but is easily rupturable by rotational movement in the opposite or unscrewing direction.

Full details of the present invention are set forth in the following description of the preferred embodiments of the invention and are shown in the accompanying drawings.

DESCRIPTION OF INVENTION

Figure 1:
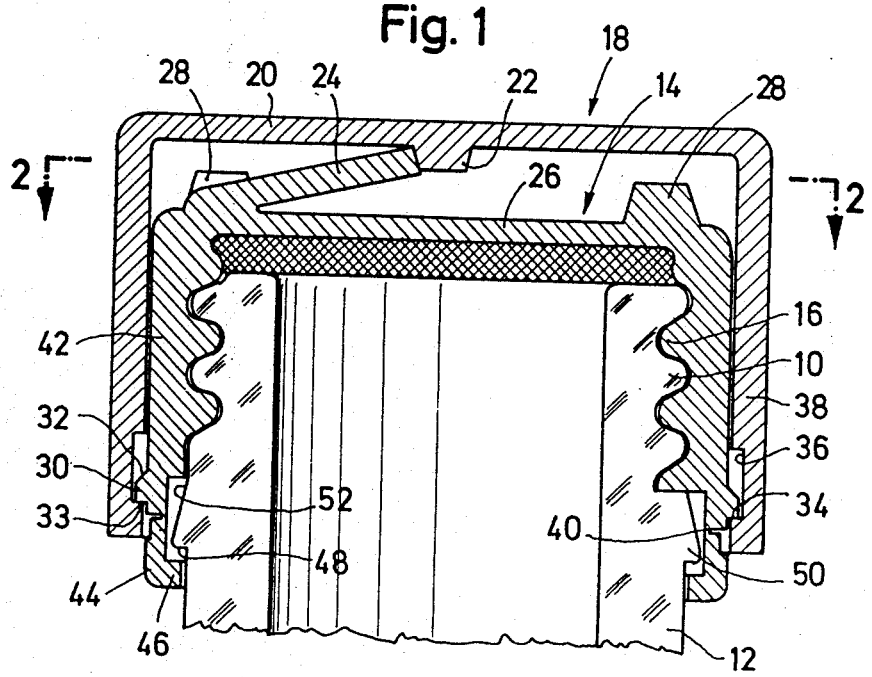
FIG. 1 is an axial section through the closure of the present invention when first placed over the neck of the container.

A flask, bottle or container is shown in FIG. 1 which is provided with a screw thread 10 on the outer surface of its neck 12. Screwed over the neck 12 is an inner cap generally depicted by the numeral 14, having inner threads 16 cooperating with those on the neck 12. An outer cap, generally depicted by the numeral 18, is secured over the cap 14 for axial movement relative thereto. The inner surface of the top crown 20 of the outer cap 18 is formed with a coupling comprising a pair of opposing dogs 22 which as seen in the position shown in FIG. 1 cooperate with arcuate spring tongues 24 which extend upwardly from the top surface of the crown 26 of the inner cap 14. On this top surface 26 of the inner cap and adjacent the fixed end for each of the tongues 24 is another dog 28. The dogs 22 and 28 are aligned in the same arc, equidistant from the center of the caps and cooperatively engage to form an engaging coupling when it is desired to press the caps 18 downwardly as seen in FIG. 3. The dogs 22 together with the spring tongues 24 define a coupling arrangement for coupling the outer and inner caps in any position of the outer cap when the latter is rotated clockwise (FIG. 2) onto the neck 12.

In order to hold the inner cap within the outer cap, the inner cap is provided with an annular collar 30 which has an inclined upper edge 32 and a flat horizontally extending bottom edge 33 which is adapted to engage with a straight edge 34 of an annular groove 36 formed in the inside wall of the skirt 38 of the outer cap 18. The groove 36 has a height sufficient to permit the axial cap 18 to move axially between an upper position where the edges 33 and 34 engage and a lower position defined by the engagement of the dogs 28 with the interior surface of the top of the outer cap 18.

By means of thin bridging strips 40 the skirt 42 of the inner cap 14 is bound together with a securing ring 44. This securing ring 44 has an L shape cross section, the shorter leg 46 of which extends radially inward flange like toward the neck of the container to engage beneath a horizontal shoulder 48 formed by an annular bead 50 on the neck 12. The bead 50 is below the threaded portion 10 and is shaped in the form of a right triangle having a sloping upper face 50 which as will be later explained provides an incline slide surface for the securing ring 44.

As seen in the enlarged detail of FIG. 3 the securing ring 44 has a flat shoulder 54 whose distance from the shoulder 33 of the collar 30 is at least as large or slightly larger than the distance of the side wall 34 of the groove 36 from the lower edge of the skirt 38 of the outer cap 18. Therefore in the position of the outer cap 18, shown in FIG. 1, the securing ring 44 can be readily expanded to slip over the annular head 50.

Figure 2:
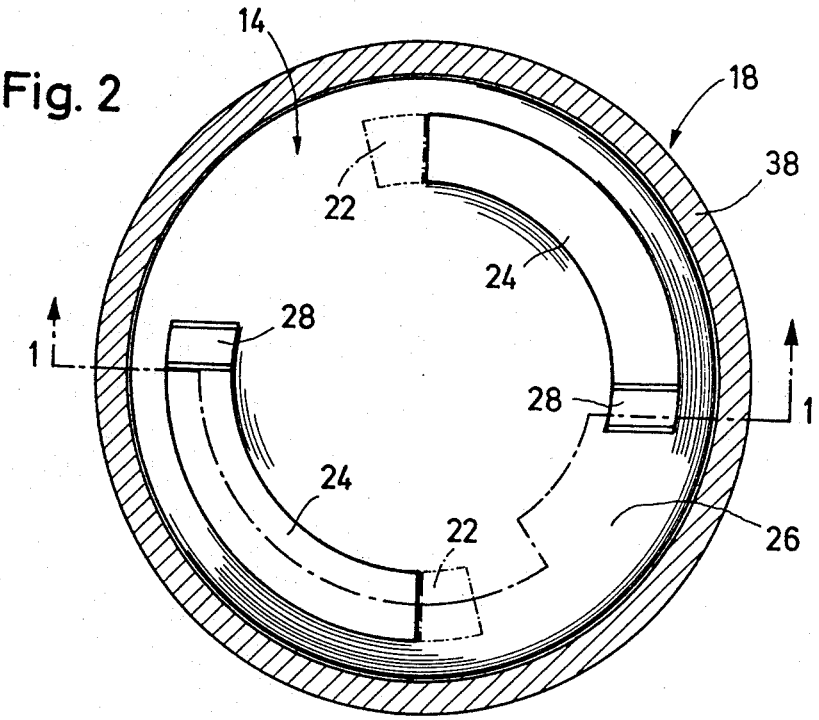
FIG. 2 is a sectional view along line 2—2 of FIG. 1.
Figure 3:
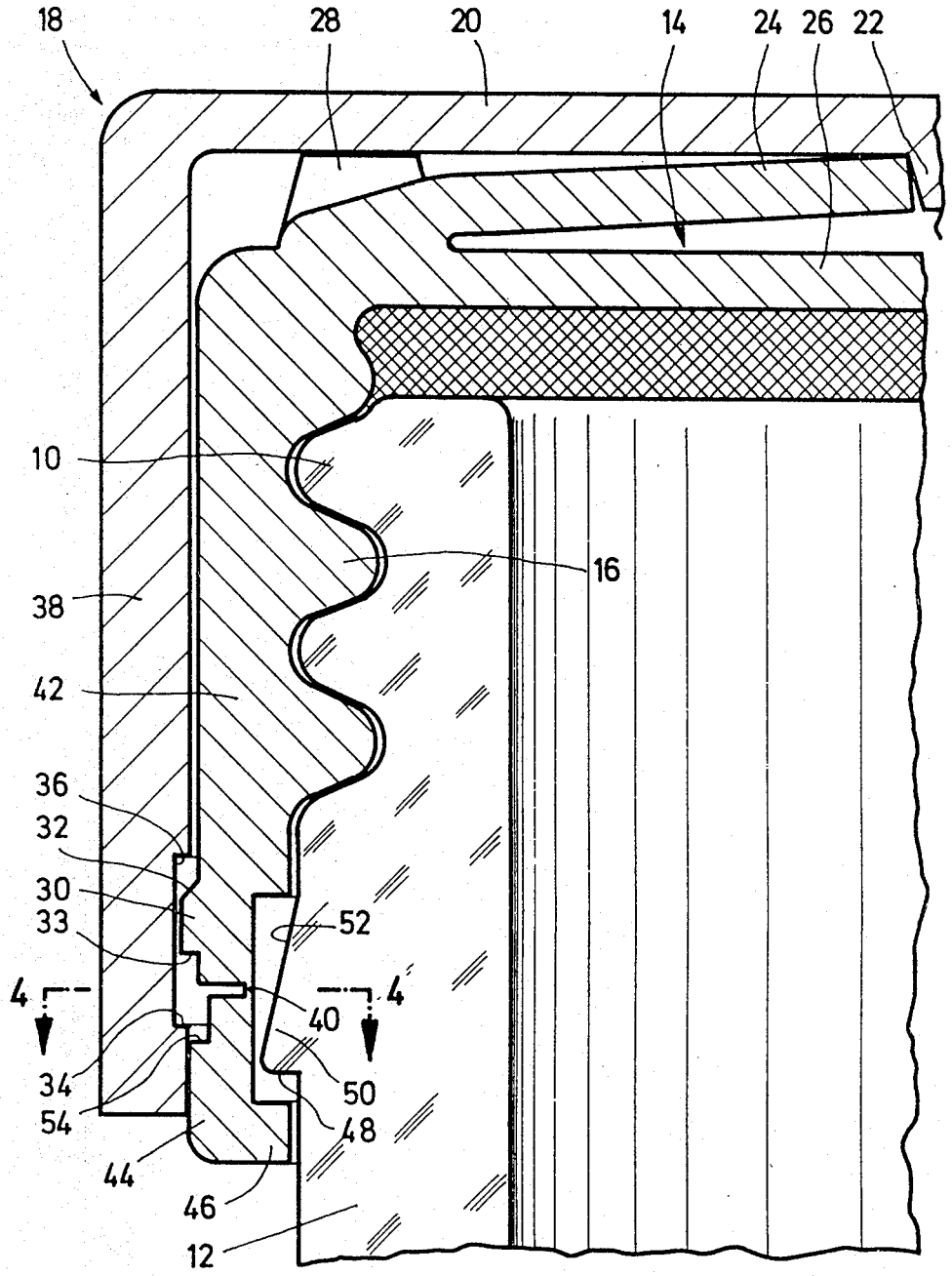
FIG. 3 is an enlarged view of a portion of FIG. 1 showing the outer cap in depressed position.

The devices as seen in FIGS. 1–3 is used as follows:

To assemble both the inner cap 14 and the outer cap 18 together it is necessary only to push the outer cap over the inner cap so that the lower edge of the skirt 38 slides on the sloping face 32 of the collar 30 and is extended elastically whereby the lower edge snaps over the shoulder 38 of the collar. Thereafter, by turning the outer cap 18 in a clockwise direction the dogs 22 are caused to abut against the free end of the spring tongues 24. Therefore, the outer cap 18 must not be pressed downwardly relative to the inner cap 14, when the closure is screwed on to the neck 12 of the container. Thus the lower area of the skirt 38 is left to lie between the shoulder 33 of the collar 30 and the shoulder 54 of the securing ring 44. This allows the securing ring to remain free with a degree of radial elastic expansion when the closure is first put on the container. The inner cap 14 can therefore be turned on to the threads 10 of the container neck 12 simultaneously causing the securing ring 44 to slide over the flaring face 52 of the bead 50.

Since in the upper position as shown in FIG. 1 the lower portion of the skirt 38 of the outer cap 18 cannot interfere with the radial elastic distention of the securing ring 44, the securing ring 44 flexes about the hinge like bridging strips 40 which hold it to the skirt 42 of the inner cap. By rotating the inner cap 14 the securing ring 44 is caused to snap over the bead 50 so that a so-called "original closure" is obtained wherein the securing ring is fixed beneath the bead 50.

Subsequently, by turning the outer cap 18 counterclockwise (i.e. in the unscrewing direction) the coupling between the dog 22 and the spring tongue 24 is disengaged and the outer cap 18 must be pressed downwardly in order to unscrew the closure. The depression of the outer cap in the counterclockwise direction also causes the dog 28 to abut in the path of the dog 22 so that the inner cap 14 is fixedly coupled with the outer cap rotating in the counterclockwise direction and is carried with it during the turning full stop. Because of the horizontally extending face of the shoulder 48 on the bead 50, the securing ring 44 which is still attached to the inner cap, cannot be withdrawn upwardly once the ring is snapped over the bead and thus fixedly engages with the bead. The same would occur even if the shoulder 48 were not horizontal or even if the securing ring 44 did not have a right angle L shaped profile, since the outer cap 18 (see FIG. 3), pressed downwardly for unscrewing, has its lower edge portion or skirt extending contiguously aligned about and envelopes the securing ring 44 thus preventing the ring from flaring outwardly or distending radially. By continuing this counterclockwise rotation the securing ring can be torn from the inner cap by a rupturing of the bridging strips 40.

Figure 4:
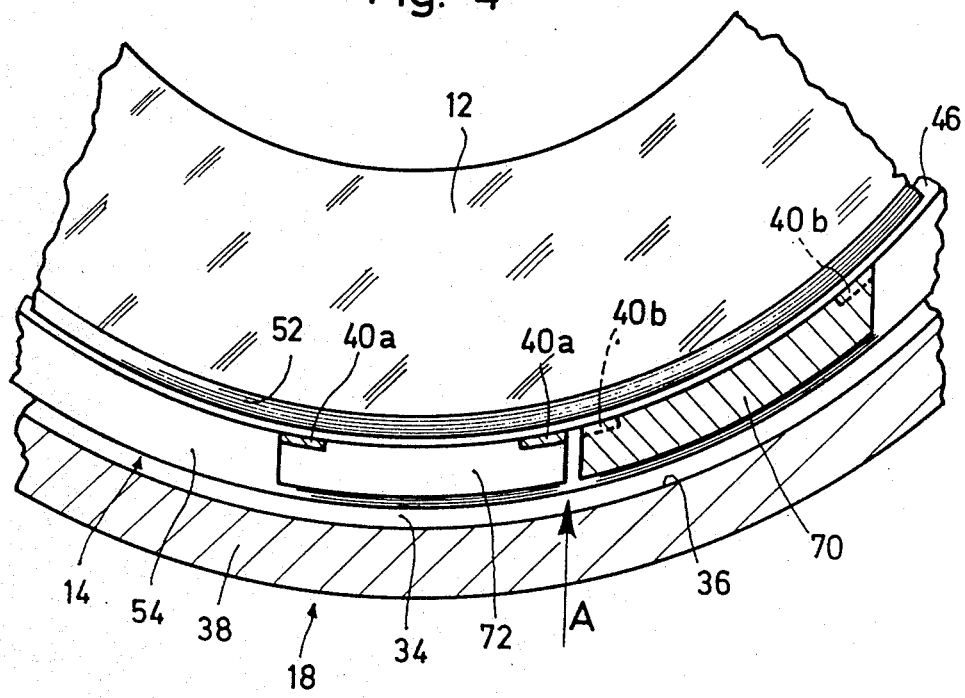
FIG. 4 is a sectional view along lines 4—4 of FIG. 3.
Figure 5:
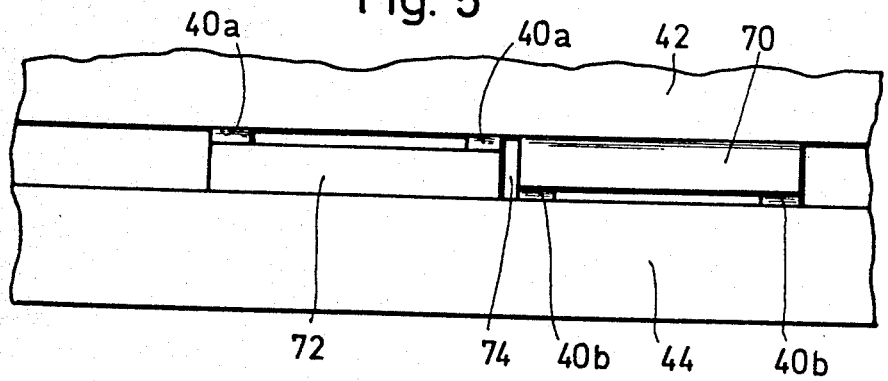
FIG. 5 is a view along the line of arrow A of FIG. 4.
Figure 6:
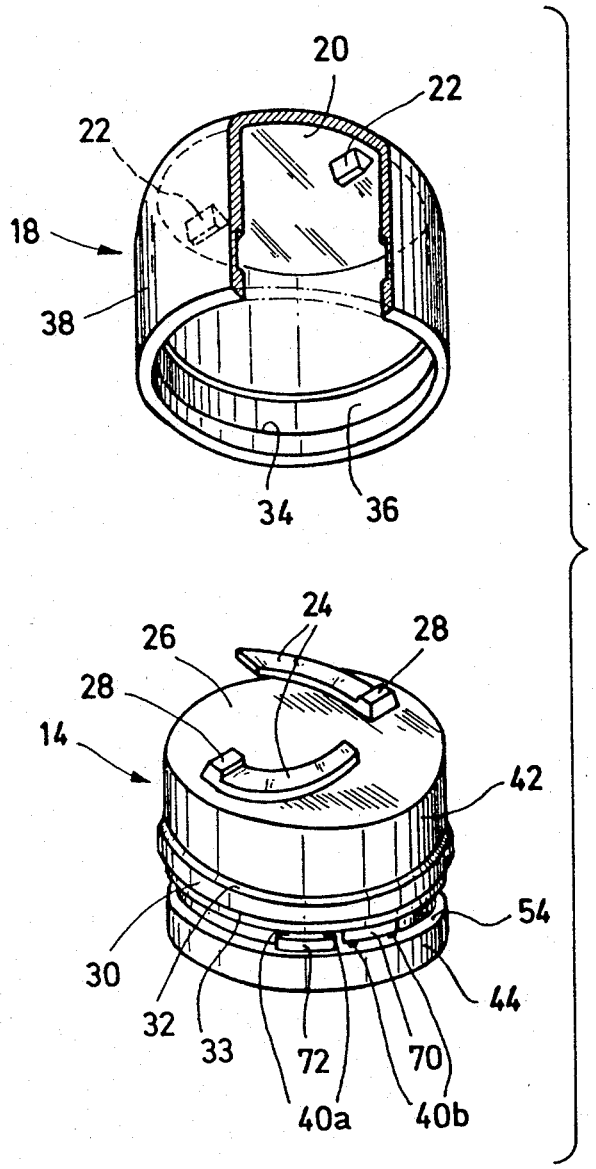
FIG. 6 is an exploded perspective view of the closure, of the present invention.

It is possible, that when originally installing the safety screw cap on the neck of the container that the forceful turning of the closure, would result in a tearing apart of the connecting strips 40 which hold the securing ring 44 to the inner cap 14. In order to provide a satisfactory function and operation of the present invention as an absolutely safe "original closure," further steps have been taken as will be seen in FIGS. 4 and 5. In these figures a lobe or cam projection 70 is formed to extend from the lower edge of the skirt 42 of the inner cap and a similar lobe or cam projection 72 is formed to extend from the upper edge of the securing ring 44. The two projections 70 and 72 are separated by a very small space 74 which is required in any event as a consequence of the method of manufacture. The several portions of the closure of the present invention are made from moldable or cast material and since the securing ring is unitary with the inner cap, it is not possible to make the oppositely lying projections 70 and 72 without the space 74. The projections 72 of the securing ring are connected via the strips **40*a* with the skirt 42 while the projections 70 of the inner cap are connected via strips 40*b* with the securing ring 44. In the event more than one pair of projections 70 and 72 are provided these are arranged with a greater distance than that of the shown pair of projections. Thus in the direction of rotation that is to screw the cap onto the container, the distances for 74** are very small while in the opposite or unscrewing direction the distances between the cam projections are very large.

When the present closure is first placed on the neck of the container the strips **40*a* and 40*b* must not function to transmit the turning movement to the securing ring 44, since this is to be taken over only by the cam projections 70 and 72. The strips only are required to be deformed to a degree equal to the distance 74 between the projections 70 and 72. In this way the bridging strips flex without tearing and permit the projections 70 and 72 to abut each other so that the rotational moment may be transmitted from the cap directly to the securing ring. The distance 74 is in enlarged in the drawing of the figures in order to make the drawings clear, however it is to be understood that this distance 74 is extremely small and less than the distance required for the strips 40*a* and 40*b* to flex. Except to transmit rotational movement during placement of the cap on the container neck the cam projections 70 and 72 have no other function. The strips 40*a* and 40*b* are capable of being ruptured or torn after the inwardly radial horizontal flange 46 of the securing ring 44 passes over the shoulder 48 of the bead 50. Any upward movement of the inner cap as by an attempt to unscrew it causes the flange 46 to engage the shoulder 48 and allows the strips 40*a* and 40*b* to be torn without interference of the cam projections 70 and 72**.

Since the resilient spring tongues 24 moreover must be elastic, one can use as a material for the inner cap of this invention an elastic synthetic material such as a thermoplastic, acetal or acetate resin or the like. The security ring may also be made from such material.

It will be seen from the foregoing that the various advantages and objects of the present invention are simply and easily obtained by the construction of the present invention. Various changes, modifications and embodiments may be made by those skilled in the art without departing from the scope of the invention. It is accordingly intended that the present disclosure be for illustrative purposes only and that the scope of the invention be limited solely by the appended claims.

What is claimed is:

1. The combination of a safety screw closure and a container having a threaded neck and an annular shoulder arranged below said threads, said closure comprising an inner and outer screw cap located one inside the other, said inner screw cap rotatable about said threaded neck in one direction to close thereon and in an opposite direction to open, said outer cap being rotatable with respect to said inner cap and axially slidable between an outer and inner position, a spring located between said caps to normally urge said outer cap into its axial outer position, said outer cap being movable against said spring into its inner axial position, means for cooperatively coupling said outer cap to said inner cap in any axial position for conjoint rotation with said inner cap in the closing direction and for cooperatively coupling said outer cap with said inner cap in its inner axial position for conjoint rotation with said inner cap in the opening direction, said inner cap having a securing ring attached at its lower end by at least one rupturable connecting bridge member, said securing ring being preshaped to conform to the shape of said annular shoulder, and being radially elastically expandable thereover, said securing ring and the inner cap being provided with intermediate cam members which cooperatingly abut when the closure is screwed on to the container and which are cooperatively ineffective when the closure is unscrewed, whereby only on initially opening of said cap said bridging members are ruptured.

2. The combination according to claim 1 wherein said outer cap has a length maintaining said securing ring free of radial envelopment when said outer cap is located in the outer axial position and radially surrounding said securing ring to prevent radial expansion when said outer cap is located in the inner axial position.

3. The combination according to claim 1 wherein the outer cap when in the second position envelopes the securing ring and prevents radial play thereof.

4. The combination according to claim 1 wherein the neck of the container is provided with an annular bead having a cross section in the form of a right triangle, one side of which forms said shoulder.

5. The combination according to claim 1 wherein the cam members are spaced apart a very small distance in the direction of screwing and a large distance the opposite direction of unscrewing

6. The combination according to claim 1 wherein the connecting bridge members are so dimensioned that when initially screwed on the container they are not rupturable and when initially unscrewed are rupturable.

7. The combination according to claim 1 wherein the coupling is formed so that the inner and outer caps are engaged in the first position to permit the inner and outer caps to move conjointly when the closure is screwed on the container.

8. The combination according to claim 7 wherein the spring and cap are integrally formed.

* * * * *